US006920935B2

(12) United States Patent
Metcalfe

(10) Patent No.: US 6,920,935 B2
(45) Date of Patent: Jul. 26, 2005

(54) EXPANDABLE DOWNHOLE TUBING

(75) Inventor: Paul David Metcalfe, Bucklerburn Steading (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/216,521

(22) Filed: Aug. 9, 2002

(65) Prior Publication Data

US 2002/0189818 A1 Dec. 19, 2002

Related U.S. Application Data

(63) Continuation of application No. 09/530,301, filed as application No. PCT/GB98/03261 on Nov. 2, 1998, now Pat. No. 6,454,013.

(30) Foreign Application Priority Data

Nov. 1, 1997 (GB) ..... 9723031

(51) Int. Cl.[7] ..... E21B 43/10

(52) U.S. Cl. ..... 166/382; 166/207

(58) Field of Search ..... 166/227, 682, 166/200, 207

(56) References Cited

U.S. PATENT DOCUMENTS

| | | | | |
|---|---|---|---|---|
| 988,054 A | | 3/1911 | Wiet | |
| 1,233,888 A | | 7/1917 | Leonard | 144/207 |
| 1,301,285 A | | 4/1919 | Leonard | |
| 1,880,218 A | | 10/1932 | Simmons | |
| 1,981,525 A | | 11/1934 | Price | 166/4 |
| 2,017,451 A | | 10/1935 | Wickersham | 166/10 |
| 2,214,226 A | | 9/1940 | English | 166/1 |
| 2,383,214 A | | 8/1945 | Prout et al. | 153/82 |
| 2,424,878 A | | 7/1947 | Crook | 154/82 |
| 2,499,630 A | | 3/1950 | Clark | 153/81 |
| 2,519,116 A | | 8/1950 | Crake | 166/10 |
| 2,627,891 A | | 2/1953 | Clark | 153/82 |
| 2,633,374 A | | 3/1953 | Boice | 285/118 |
| 2,812,025 A | * | 11/1957 | Teague et al. | 166/207 |
| 3,028,915 A | | 4/1962 | Jennings | 166/16 |
| 3,039,530 A | | 6/1962 | Condra | 166/55 |
| 3,167,122 A | | 1/1965 | Lang | 166/14 |
| 3,179,168 A | | 4/1965 | Vincent | 166/14 |
| 3,186,485 A | | 6/1965 | Owen | 166/63 |
| 3,191,677 A | | 6/1965 | Kinley | 166/14 |
| 3,191,680 A | | 6/1965 | Vincent | 166/46 |
| 3,203,451 A | | 8/1965 | Vincent | 138/143 |

(Continued)

FOREIGN PATENT DOCUMENTS

| | | | |
|---|---|---|---|
| DE | 3213464 A1 | 10/1983 | B23D/45/12 |
| DE | 4133802 C1 | 10/1992 | F16L/9/12 |
| EP | 0 952 305 A1 | 4/1998 | E21B/43/10 |

(Continued)

OTHER PUBLICATIONS

Metcalfe, P.—"Expandable Slotted Tubes Offer Well Design Benefits", *Petroleum Engineer International*, vol. 69, No. 10 (Oct. 1996), pp. 60–63—XP000684479.
U.S. Appl. No. 09/554,677, filed Nov. 19, 1998.
U.S. Appl. No. 09/469,681, filed Dec. 22, 1999.
U.S. Appl. No. 09/469,643, filed Dec. 22, 1999.
U.S. Appl. No. 09/469,526, filed Dec. 22, 1999.
U.S. Appl. No. 09/426,654, filed Jul. 13, 1998.

*Primary Examiner*—Hoang Dang
(74) *Attorney, Agent, or Firm*—Moser, Patterson & Sheridan, L.L.P.

(57) ABSTRACT

A tubing coupling method is provided. In one aspect, the method comprises providing a length of expandable tubing and a length of larger diameter non-expanding tubing, connecting an end portion of the expandable tubing to an end portion of the non-expanding tubing, running the tubing into a bore, and expanding the expandable tubing. The expandable tubing may form part of an expandable well or sand screen, or may be an expandable bore liner.

7 Claims, 3 Drawing Sheets

U.S. PATENT DOCUMENTS

| | | | | | |
|---|---|---|---|---|---|
| 3,203,483 | A | | 8/1965 | Vincent | 166/207 |
| 3,245,471 | A | | 4/1966 | Howard | 166/46 |
| 3,297,092 | A | | 1/1967 | Jennings | 166/207 |
| 3,326,293 | A | | 6/1967 | Skipper | 166/150 |
| 3,353,599 | A | | 11/1967 | Swift | 166/15 |
| 3,354,955 | A | | 11/1967 | Berry | 166/14 |
| 3,412,565 | A | * | 11/1968 | Lindsey et al. | 405/231 |
| 3,477,506 | A | | 11/1969 | Malone | 166/207 |
| 3,489,220 | A | | 1/1970 | Kinley | 166/277 |
| 3,583,200 | A | | 6/1971 | Cvijanovic et al. | 72/393 |
| 3,669,190 | A | | 6/1972 | Sizer et al. | 166/315 |
| 3,689,113 | A | | 9/1972 | Blaschke | 285/90 |
| 3,691,624 | A | | 9/1972 | Kinley | 29/523 |
| 3,712,376 | A | | 1/1973 | Owen et al. | 166/277 |
| 3,746,091 | A | | 7/1973 | Owen et al. | 166/207 |
| 3,776,307 | A | | 12/1973 | Young | 166/125 |
| 3,780,562 | A | | 12/1973 | Kinley | 72/479 |
| 3,785,193 | A | | 1/1974 | Kinley et al. | 72/393 |
| 3,820,370 | A | | 6/1974 | Duffy | 72/75 |
| 3,948,321 | A | | 4/1976 | Owen et al. | 166/277 |
| 3,977,076 | A | | 8/1976 | Vieira et al. | 30/103 |
| 4,319,393 | A | | 3/1982 | Pogonowski | 29/434 |
| 4,349,050 | A | | 9/1982 | Bergstrom et al. | 138/147 |
| 4,359,889 | A | | 11/1982 | Kelly | 72/62 |
| 4,362,324 | A | | 12/1982 | Kelly | 285/119 |
| 4,382,379 | A | | 5/1983 | Kelly | 73/46 |
| 4,387,502 | A | | 6/1983 | Dom | 29/568 |
| 4,407,150 | A | | 10/1983 | Kelly | 72/61 |
| 4,414,739 | A | | 11/1983 | Kelly | 29/727 |
| 4,445,201 | A | | 4/1984 | Pricer | 365/154 |
| 4,450,612 | A | | 5/1984 | Kelly | 72/62 |
| 4,470,280 | A | | 9/1984 | Kelly | 72/61 |
| 4,483,399 | A | | 11/1984 | Colgate | 166/308 |
| 4,487,630 | A | | 12/1984 | Crook et al. | 75/123 B |
| 4,502,308 | A | | 3/1985 | Kelly | 72/58 |
| 4,505,142 | A | | 3/1985 | Kelly | 72/54 |
| 4,505,612 | A | | 3/1985 | Shelley, Jr. | 405/101 |
| 4,567,631 | A | | 2/1986 | Kelly | 29/157.3 |
| 4,581,617 | A | | 4/1986 | Yoshimoto et al. | 346/108 |
| 4,626,129 | A | | 12/1986 | Kothmann et al. | 405/43 |
| 4,807,704 | A | | 2/1989 | Hsu et al. | 166/313 |
| 4,866,966 | A | | 9/1989 | Hagen | 72/75 |
| 4,883,121 | A | | 11/1989 | Zwart | 166/217 |
| 4,976,322 | A | | 12/1990 | Abdrakhmanov et al. | 175/57 |
| 4,997,320 | A | | 3/1991 | Hwang | 408/22 |
| 5,014,779 | A | | 5/1991 | Meling et al. | 166/55.7 |
| 5,031,699 | A | | 7/1991 | Artynov et al. | 166/285 |
| 5,052,483 | A | | 10/1991 | Hudson | 166/55 |
| 5,052,849 | A | | 10/1991 | Zwart | 403/300 |
| 5,156,209 | A | | 10/1992 | McHardy | 166/324 |
| 5,267,613 | A | | 12/1993 | Zwart et al. | 166/178 |
| 5,271,472 | A | | 12/1993 | Leturno | 175/107 |
| 5,301,760 | A | | 4/1994 | Graham | 175/61 |
| 5,307,879 | A | | 5/1994 | Kent | 166/382 |
| 5,322,127 | A | | 6/1994 | McNair et al. | 166/313 |
| 5,348,095 | A | | 9/1994 | Worrall et al. | 166/380 |
| 5,366,012 | A | | 11/1994 | Lohbeck | 166/277 |
| 5,409,059 | A | | 4/1995 | McHardy | 166/208 |
| 5,472,057 | A | | 12/1995 | Winfree | 175/57 |
| 5,520,255 | A | | 5/1996 | Barr et al. | 175/24 |
| 5,553,679 | A | | 9/1996 | Thorp | 175/73 |
| 5,560,426 | A | | 10/1996 | Trahan et al. | 166/120 |
| 5,636,661 | A | | 6/1997 | Moyes | 137/614.2 |
| 5,667,011 | A | | 9/1997 | Gill et al. | 166/295 |
| 5,706,905 | A | | 1/1998 | Barr | 175/61 |
| 5,785,120 | A | | 7/1998 | Smalley et al. | 166/55 |
| 5,887,668 | A | | 3/1999 | Haugen et al. | 175/79 |
| 5,901,789 | A | | 5/1999 | Donnelly et al. | 166/381 |
| 5,924,745 | A | | 7/1999 | Campbell | 285/90 |
| 5,960,895 | A | | 10/1999 | Chevallier et al. | 175/27 |
| 5,979,571 | A | | 11/1999 | Scott et al. | 175/61 |
| 5,984,568 | A | | 11/1999 | Lohbeck | 403/375 |
| 6,012,522 | A | | 1/2000 | Donnelly et al. | 166/276 |
| 6,012,523 | A | | 1/2000 | Campbell et al. | 166/277 |
| 6,029,748 | A | | 2/2000 | Forsyth et al. | 166/380 |
| 6,050,341 | A | | 4/2000 | Metcalf | 166/383 |
| 6,070,671 | A | | 6/2000 | Cumming et al. | 166/381 |
| 6,085,838 | A | | 7/2000 | Vercaemer et al. | 166/277 |
| 6,112,818 | A | | 9/2000 | Campbell | 166/384 |
| 6,273,634 | B1 | | 8/2001 | Lohbeck | 403/297 |
| 6,325,148 | B1 | | 12/2001 | Trahan et al. | 166/297 |
| 6,425,444 | B1 | | 7/2002 | Metcalfe et al. | 166/387 |
| 6,446,323 | B1 | | 9/2002 | Metcalfe et al. | 29/523 |
| 6,454,013 | B1 | | 9/2002 | Metcalfe | 166/382 |
| 6,457,532 | B1 | | 10/2002 | Simpson | 166/380 |
| 6,457,533 | B1 | | 10/2002 | Metcalfe | 166/381 |
| 2001/0040054 | A1 | | 11/2001 | Haugen et al. | |

FOREIGN PATENT DOCUMENTS

| | | | | |
|---|---|---|---|---|
| GB | 730338 | | 3/1954 | 84/4 |
| GB | 792886 | | 4/1956 | |
| GB | 997721 | | 7/1965 | |
| GB | 1277461 | | 6/1972 | B21D/39/04 |
| GB | 1448304 | | 9/1976 | E21B/33/13 |
| GB | 1457843 | | 12/1976 | B21D/39/10 |
| GB | 1582392 | | 1/1981 | E21D/39/10 |
| GB | 2216926 | A | 10/1989 | E21B/7/20 |
| GB | 2313860 | B | 6/1996 | E21B/10/34 |
| GB | 2322655 | A | 2/1998 | E21B/23/094 |
| GB | 2329918 | A | 4/1999 | E21B/43/10 |
| WO | WO 92/01139 | | 1/1992 | E21B/17/08 |
| WO | WO 93/24728 | | 12/1993 | E21B/17/10 |
| WO | WO 93/25800 | | 12/1993 | E21B/43/10 |
| WO | WO 94/25655 | | 11/1994 | D04C/1/06 |
| WO | WO 96/01250 | | 1/1996 | C07C/53/06 |
| WO | WO 96/03261 | | 2/1996 | B26F/1/14 |
| WO | WO 97/17524 | | 5/1997 | E21B/43/08 |
| WO | WO 97/21901 | | 6/1997 | E21B/17/08 |
| WO | WO 98/00626 | | 1/1998 | E21B/43/10 |
| WO | WO 99/18328 | | 4/1999 | E21B/23/01 |
| WO | WO 99/23354 | | 5/1999 | E21B/43/10 |
| WO | WO 99/02818 | | 10/1999 | E21B/43/10 |

* cited by examiner

EXPANDABLE DOWNHOLE TUBING

CROSS-REFERENCE TO RELATED APPLICATIONS

This application is a continuation of U.S. patent application Ser. No. 09/530,301, filed Jun. 8, 2000 now U.S. Pat. No. 6,454,013, which was the National Stage of International Application No. PCT/GB98/03261, filed Nov. 2, 1998 and published under PCT Article 21(2) in English, and claims priority of United Kingdom Application No. 9723031.2 filed on Nov. 1, 1997. Each of the aforementioned related patent applications is herein incorporated by reference.

BACKGROUND OF THE INVENTION

1. Field of the Invention

This invention relates to expandable downhole tubing. In particular, the invention relates to coupling or connecting expandable downhole tubing. One aspect of the invention relates to a method of locating a section of expandable tubing in a bore.

2. Description of the Related Art

Expandable tubing for use in downhole applications is useful as, for example, borehole liner or as a sandscreen support. In one application, a section of expandable tubing is positioned in an unlined section of bore intersecting a hydrocarbon-bearing formation, below an existing bore casing and bore liner. The tubing is then expanded, preferably into contact with the bore wall. The expanded liner supports the bore wall while allowing oil and gas to pass from the formation into the bore. In another application, an expandable well screen is provided, the screen comprising perforated filter sheets mounted on an expandable slotted carrier tube and within a coaxial expandable slotted protective tube. The well screen is expanded downhole to such a size that the protective tube can be set against the surrounding formation.

For locating expandable tubing in a bore it would be preferable to provide a secure connection between the upper end of the expandable tubing and the lower end of an existing bore liner; simply locating the tubing in the liner, with no mechanical connection therebetween, may result in an offset between the two, creating an irregularity on which tools may snag and an unwanted gap through which fluid may flow.

U.S. Pat. No. 3,353,599 discloses a method for securing ends of expandable liner to solid surrounding tubing by means of plastic impregnated glass filter mats. However, the applicant considers that this method would encounter many difficulties in this particular application due to, for example, contamination of the mats by the fluid in the bore and the possibility of the mats being dislodged or damaged during installation of the liner and the expandable tubing, or during other downhole operations.

SUMMARY OF THE INVENTION

It is among the objectives of the present invention to obviate or mitigate these disadvantages. According to the present invention there is provided a method of coupling a section of expandable tubing, the method comprising the steps: providing a length of expandable tubing and a length of larger diameter non-expanding tubing; connecting an end portion of said expandable tubing to an end portion of said non-expanding tubing with a portion of expandable tubing; running the tubing into a bore; and expanding the expandable tubing.

According to a further aspect of the present invention there is provided a tubing assembly comprising a length of expandable tubing, a length of larger diameter non-expanding tubing, and a connecting portion of expandable tubing connecting an end portion of the expandable tubing to an end portion of the non-expanding tubing.

These aspects of the invention facilitate connection of a length of expandable tubing to a length of non-expanding tubing. The expandable tubing may be a borehole liner or support, or may form part of an expandable well screen or sand screen. The non-expanding tubing may be a solid connector or coupling, and thus may be a solid connector for joining two lengths of expandable tubing. In particular, this embodiment of the invention permits expandable well screen or sand screen sections to be connected using solid connectors, obviating the difficulties involved in connecting such well screen sections utilising expandable connectors.

The connecting portion may be formed by partially expanding an end of the expandable tubing to a diameter corresponding to the non-expanding tubing. Alternatively, the non-expanding tubing may have an expandable tapering end portion which forms the connecting portion, the smaller diameter end of the tapering portion being of a diameter corresponding to the expandable tubing.

The connecting portion may be welded to one or both of the expandable tubing and the non-expanding tubing. Alternatively, the connection may be provided by other means, such as screw threads, pins, screws, rivets or radially movable keys or fingers engaging corresponding profiles.

According to another aspect of the present invention there is provided a method of locating a section of expandable tubing in a bore, the method comprising the steps: providing a length of expandable tubing and a length of larger diameter non-expanding tubing; connecting an end portion of said expandable tubing to an end portion of said non-expanding tubing with a portion of expandable tubing; running the connected tubing into a bore; fixing said non-expanding tubing in the bore; and expanding the expandable tubing.

According to a still further aspect of the present invention there is provided a tubing assembly comprising a length of expandable tubing, a length of larger diameter non-expanding tubing including means for connecting the non-expanding tubing to further tubing located in a bore, and a connecting portion of expandable tubing connecting an end portion of the expandable tubing to an end portion of the non-expanding tubing, the arrangement being such that, in use, the connected tubing may be run into a bore as a unit.

Thus, in these aspects of the present invention, the expandable tubing is connected to the non-expanding tubing on surface, prior to running the expandable tubing into the bore and prior to expansion of the tubing. The non-expanding tubing may be fixed in the bore by any suitable connecting means, typically by connection to an existing section of bore liner or casing. The connection may utilise, for example, a liner hanger, a packer, cooperating screw threads or radially movable keys engaging corresponding profiles.

The expandable tubing may be a borehole liner or support, or may form part of an expandable well screen or sand screen. The connecting portion may be formed by expanding an upper end of the expandable tubing to a diameter corresponding to the non-expanding tubing. Alternatively, the non-expanding tubing may have an expandable tapering lower end portion which forms the connecting portion, the smaller diameter end of the tapering portion being of a diameter corresponding to the expandable tubing.

Preferably also, the assembly includes a running tool including means for releasably mounting the tubing thereon. The mounting means may be released utilising one of, or a combination of, mechanical force and fluid pressure. Preferably also, the running tool incorporates means for expanding the expandable tubing, which means may be a cone or mandrel which will expand the tubing when pushed or pulled therethrough. Most preferably, the expanding means is initially located within the connecting portion.

The connecting portion may be welded to one or both of the expandable tubing and the non-expanding tubing. Alternatively, the connection may be provided by other means, such as screw threads, pins, screws, rivets or radially movable keys or fingers engaging corresponding profiles.

BRIEF DESCRIPTION OF THE DRAWINGS

These and other aspects of the present invention will now be described, by way of example, with reference to the accompanying drawings, in which.

DETAILED DESCRIPTION OF THE PREFERRED EMBODIMENT

Figure 1:
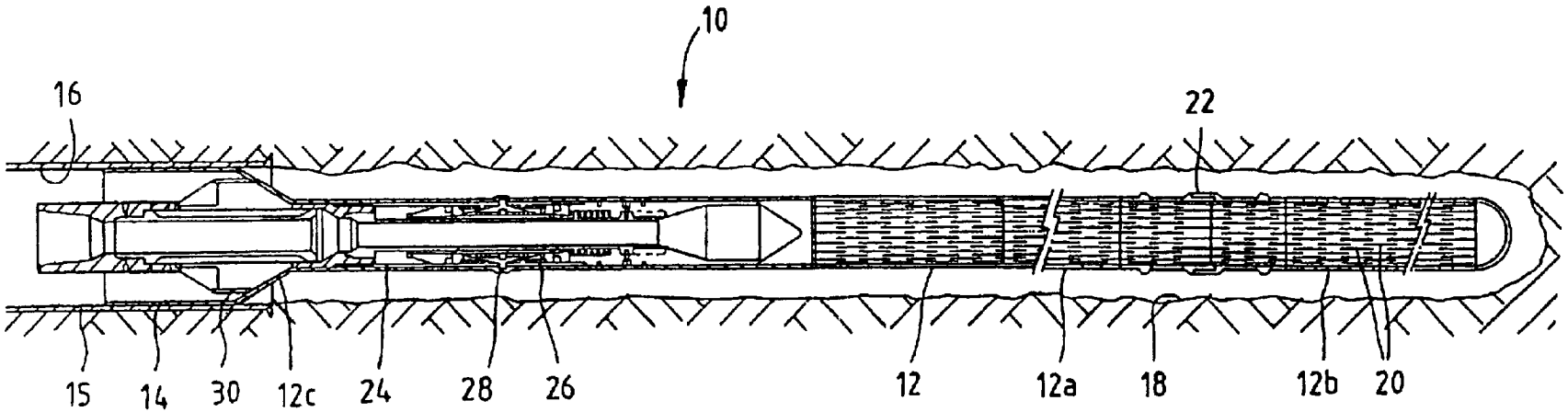
FIG. 1 is a sectional view of a tubing assembly in accordance with an embodiment of the present invention, shown located in the sump end of a bore.

The assembly 10 comprises expandable tubing 12 connected to the lower end of a non-expanding sleeve 14, the sleeve 14 being fixed relative to a section of bore casing 15 which defines a seal bore 16. The expandable tubing 12 is initially of a smaller diameter than the sleeve 14 and casing 15 and extends into the uncased lower end of a drilled bore 18, this being the section of the bore 18 which intersects the oil-bearing formation. The expandable tubing 12 includes a tubing wall defining a multiplicity of overlapping longitudinal slots 20. A number of tubing sections 12*a,* 12*b* are provided and are joined together using appropriate connectors 22.

Figure 2:
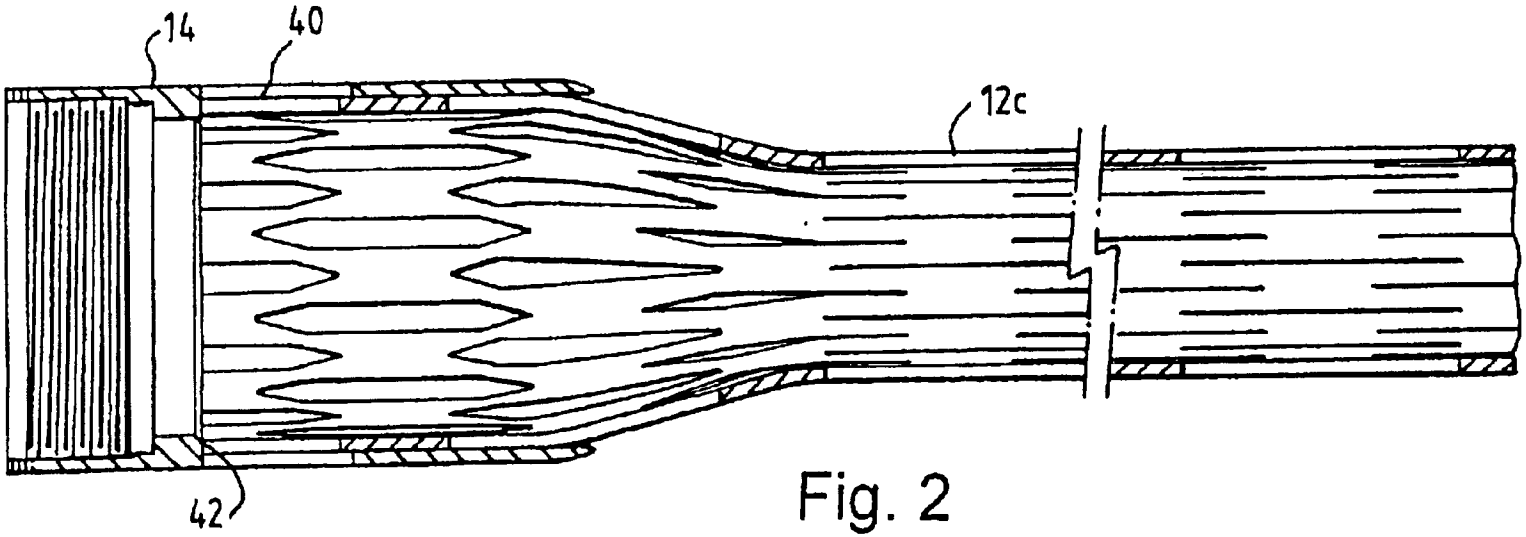
FIG. 2 is an enlarged sectional view of a portion of the tubing assembly of FIG. 1.

At its upper end 12*c,* the tubing 12 has been pre-expanded to a diameter corresponding to the diameter of the sleeve 14, and the pre-expanded portion 12*c* welded to the sleeve 14, as illustrated in greater detail in FIG. 2. The lower end portion of the sleeve 14 receives the upper pre-expanded end 12*c* of the tubing and is slotted 40, to facilitate welding of the tubing 12*c* to the sleeve 14. Further, the sleeve 14 defines a shoulder 42 for abutting the upper end of the expanded tubing end 12*c*. In use, the sleeve 14 is threaded and pinned to a liner section including a conventional hanger (not shown) for connection to the existing bore casing 15.

Located within the pre-expanded portion 12*c* is a running tool 24 for connection to the lower end of a running string (not shown), typically formed of drill pipe. The running tool 24 features radially movable keys 26 which releasably engage a profile 28 on the expandable tubing 12. The illustrated running tool may be activated by fluid pressure to retract the keys 26 and release the tubing assembly 12, 14 when desired. The upper end of the running tool 24 includes an expansion cone 30 which may be pushed downwardly to expand the tubing 12, as will be described below.

In use, the expandable tubing 12 and the sleeve 14 are welded together on the surface and the running tool 24 located within the tubing assembly 12, 14 with the keys 26 extended to engage the tubing profile 28. The running tool 24 is then mounted on the lower end of the running string and the assembly of the tubing 12, sleeve 14, liner, liner hanger and tool 24 run into the bore 18.

On reaching the lower end of the bore 18, the liner hanger is actuated to fix the liner to the lower end of the bore casing, above the uncased section of bore. The running tool 24 is then manipulated and fluid pressure applied to the tool 24 from the surface through the running string to retract the keys 26 and release the tubing 12 and liner. The running tool 24 is then pushed downwardly, through the tubing 12, such that the cone 30 expands the tubing 12 into contact with the bore wall, the solid non-expanding sleeve 14 preventing the pre-expanded tubing end 12*c* from bellowing out during expansion of the remainder of the tubing 12. The running tool 24 is then withdrawn. Thus, the invention obviates the need to form a connection between the expandable tubing 12 and the non-expanding liner while the tubing 12 and liner are downhole.

Figure 3:
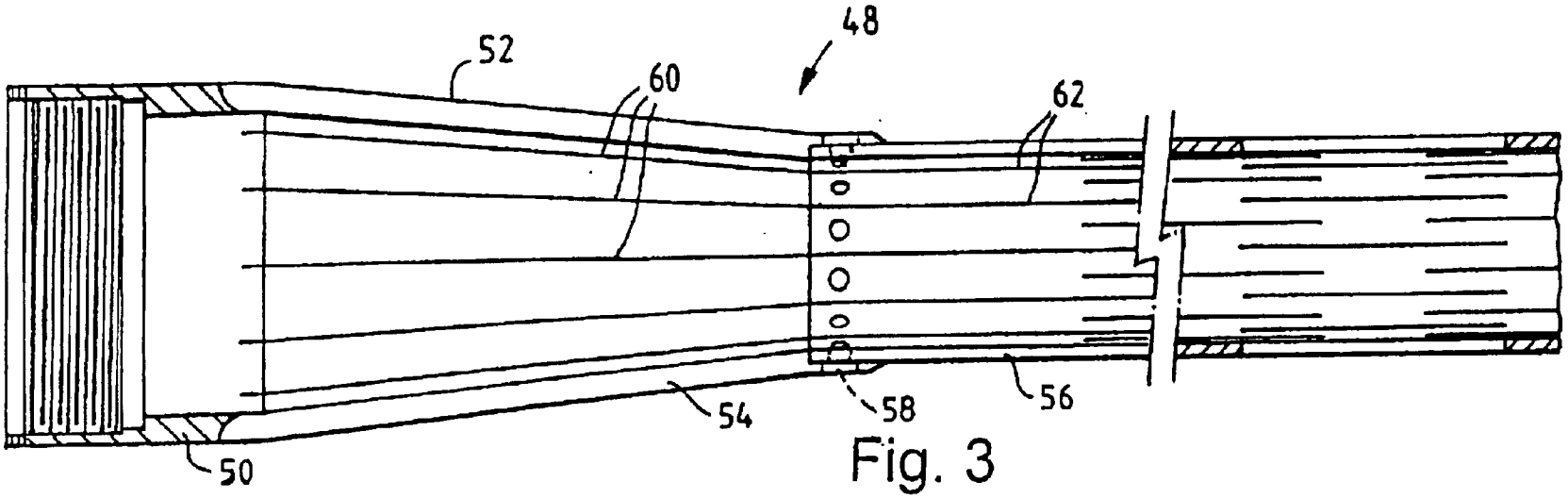
FIG. 3 is a sectional view of a portion of a tubing assembly in accordance with a further embodiment of the present invention.

Reference is now made to FIG. 3 of the drawings, which is a sectional view of a portion of a tubing assembly 48 in accordance with a further embodiment of the present invention. In this embodiment a lower liner section 50 defines a tapering connecting portion 52 formed of a plurality of connecting arms 54. The upper end of the expandable tubing 56 is fixed to the arms 54 by appropriate screws 58, and it will be noted that the slots 60 in the connecting portion 52 correspond with the slots 62 in the expandable tubing 56.

This assembly 48 is utilised in a similar manner to the assembly 10 described above, however the expansion cone 30 will expand the tapering connection portion 52 as well as the expandable tubing 56.

Figure 4:
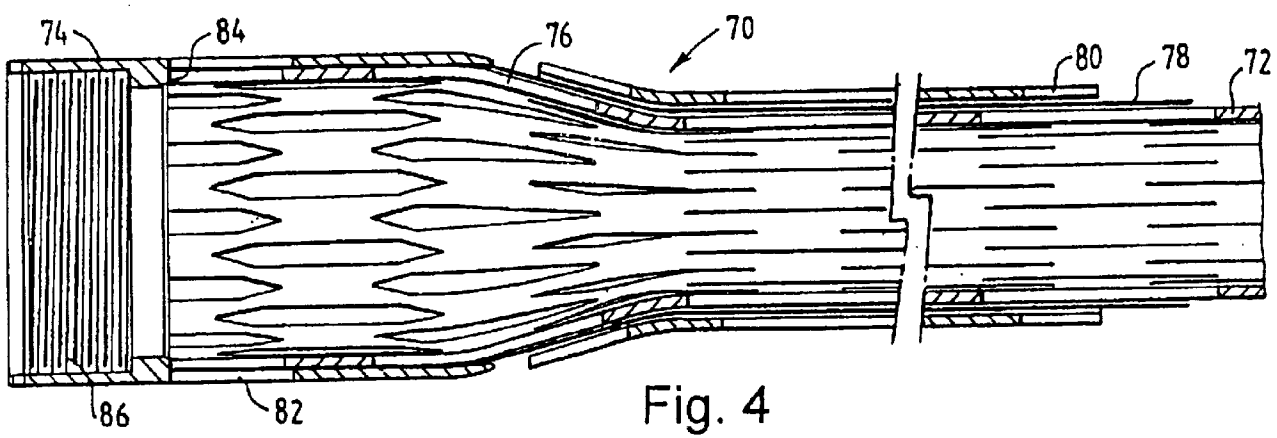
FIG. 4 is a sectional view of a portion of a tubing assembly in accordance with another embodiment of the present invention.

Reference is now made to FIG. 4 of the drawings, which illustrates a tubing assembly 70 comprising a length of expandable tubing, in the form of an expandable slotted carrier tube 72, a length of larger diameter non-expanding tubing, in the form of a solid connector 74, and a connecting portion of expandable tubing 76 connecting the end portion of the carrier tube 72 to the end portion of the connector 74.

The carrier tube 72 supports perforated filter sheets 78 and an expandable slotted protective tube 80 is mounted over the sheets 78, thus forming an expandable sand screen assembly, such as described in WO97/17524.

At its upper end, the carrier tube 72 has been pre-expanded to a diameter corresponding to the diameter of the connector 74, and the pre-expanded connecting portion 76 welded to the connector 74. The lower end portion of the connector 74 receives the connecting portion 76 and is slotted 82, to facilitate welding of the tubing portion 76 to the connector 74. Further, the connector 74 defines a shoulder 84 for abutting the upper end of the expanded tubing end 76, and an internal thread 86.

The perforated filter sheets 78 extend to adjacent the end of the carrier tube 72 and thus extend into the connector 74. The outer protective tube 80 stops short of the end of the carrier tube 72 and does not extend into the connector 74. The pre-expansion of the carrier tube 72 produces a corresponding expansion of the filter sheets 78 and an expansion of the end of the tube 80.

In use, the connector 74 is threaded and pinned to a corresponding solid connector (not shown) defining an external thread coupled to the lower end of another expandable sand screen section. A number of sand screen sections may be coupled in this manner and run downhole to a desired location in the bore. An expansion cone or the like is then pushed or pulled through the sand screen sections and causes the unexpanded and partially expanded sections of sand screen to expand to a diameter corresponding to the diameter of the connectors 74, which will correspond closely to the bore diameter. Further, as described in WO93/25800, by selecting an appropriate cone profile it is possible to expand the tubing to a diameter greater than that of the cone, and in this manner it may be possible to expand the sand screen assembly such that the outer tubing 80 is expanded into contact with the bore wall. This effect may also be achieved or facilitated by selecting the relative dimensions of the connector 74 and sand screen elements such that on expanding the inner tubing 72 to a diameter corresponding to the inner diameter of the connector 74, the outer surface of the expanded tubing 80 extends radially beyond the outer surface of the connector.

Figure 5:
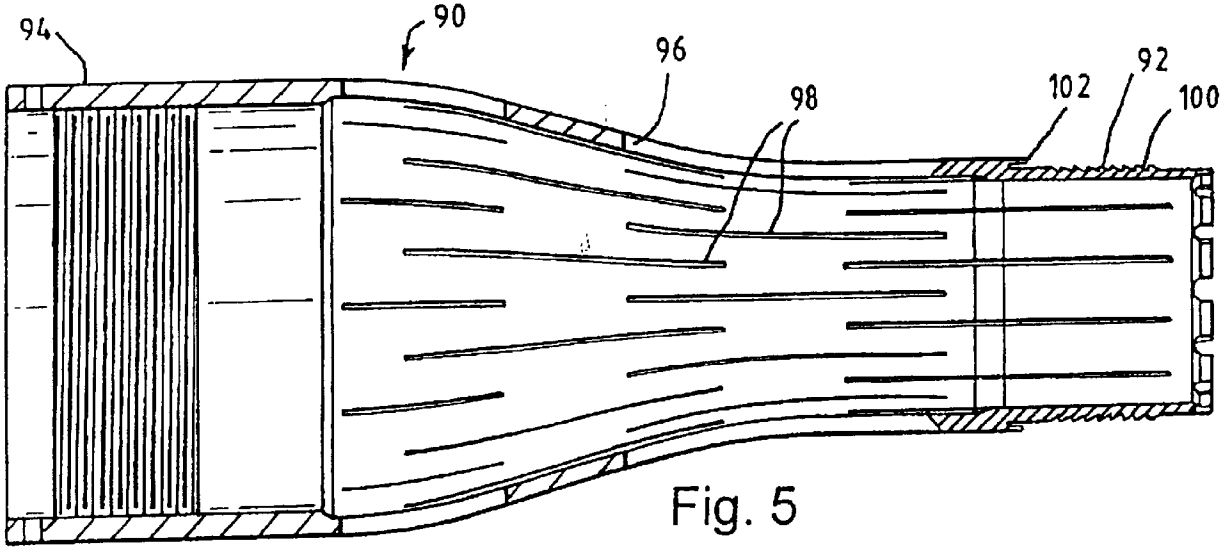
FIG. 5 is a sectional view of a portion of a tubing assembly in accordance with a still further embodiment of the present invention.

Reference is now made to FIG. 5 of the drawings, which illustrates a tubing assembly 90 in accordance with a still further aspect of the present invention. The assembly 90 comprises an expandable pin connector 92, for coupling to a section of expandable bore liner or an expandable screen, a solid crossover section 94 for coupling to a hanger, and a tapering connecting portion 96 machined in a similar manner to a section of expandable tubing, that is the portion 96 defines a number of overlapping longitudinal slots 98. The pin connector 92 defines an external thread 100, and an undercut 102 for engaging corresponding features on a connector provided on the expandable bore liner or screen.

It will be clear to those of skill in the art that the above described embodiments are merely exemplary of the present invention and that various modifications and improvements may be made thereto without departing from the scope of the invention. For example, the assembly 10 may be provided in conjunction with another form of running tool, or may be utilised to locate expandable tubing in other locations in a bore and to connect expandable tubing to other forms of solid tubing. Further, the connector 74 may be utilised to connect other forms of sand screen incorporating different filter media, or may be utilised to connect single lengths of expandable tubing.

What is claimed is:

1. A method for placing an expandable tubular in a wellbore, comprising:

lowering an expandable tubular assembly into the wellbore in a single trip, the expandable tubular assembly having a running tool assembly, an expander tool, a first portion with a first outer diameter, and a second portion with a second outer diameter, the first outer diameter being greater than the second outer diameter;

affixing the first portion to a location in the wellbore; and expanding the second portion, wherein expanding the second portion comprises traversing the expander tool through the second portion by pushing.

2. The method of claim 1, wherein the location in the wellbore is predetermined.

3. The method of claim 2, wherein the predetermined location comprises an existing wellbore feature.

4. The method of claim 1, further comprising a force application member connected to the expander tool.

5. The method of claim 4, wherein expanding the second portion comprises traversing the expander tool through the second portion by applying a force to the force application member.

6. A method for placing an expandable tubular in a wellbore, comprising:

lowering an expandable tubular assembly into the wellbore in a single trip, the expandable tubular assembly having a running tool assembly, an expander tool with a force application member connected thereto, a first portion with a first outer diameter, and a second portion with a second outer diameter, the first outer diameter being greater than the second outer diameter;

affixing the first portion to a location in the wellbore; and expanding the second portion, wherein expanding the second portion comprises traversing the expander tool through the second portion by applying a force to the force application member such that the expander tool is traversed through by pushing.

7. A method for expanding tubulars, comprising:

providing an assembly comprising a length of expandable tubing and a length of larger diameter tubing the expandable and larger diameter tubing connected end to end and the expandable tubing having at least one aperture in a wall thereof for the passage of fluid;

running the assembly into a bore with an expansion member at least partially disposed within the larger tubular during the running; and expanding the expandable tubing.

* * * * *